US006568797B2

(12) United States Patent
Yamauchi et al.

(10) Patent No.: US 6,568,797 B2
(45) **Date of Patent: *May 27, 2003**

(54) INK JET HEAD

(75) Inventors: Kunihiro Yamauchi, Hino (JP); Shinichi Nishi, Hino (JP); Yoshikazu Maekawa, Hino (JP)

(73) Assignee: Konica Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/505,137

(22) Filed: Feb. 16, 2000

(65) Prior Publication Data

US 2002/0089574 A1 Jul. 11, 2002

(30) Foreign Application Priority Data

Feb. 17, 1999 (JP) ..... 11-038142

(51) Int. Cl.[7] ..... B41J 2/045

(52) U.S. Cl. ..... 347/70; 347/71; 347/72; 347/68

(58) Field of Search ..... 347/68–72

(56) References Cited

U.S. PATENT DOCUMENTS

| | | | | | |
|---|---|---|---|---|---|
| 4,791,440 | A | * | 12/1988 | Eldridge et al. | 347/58 |
| 4,940,995 | A | * | 7/1990 | Hine et al. | 347/89 |
| 5,016,028 | A | * | 5/1991 | Temple | 347/69 |
| 5,376,857 | A | * | 12/1994 | Takeuchi et al. | 310/328 |
| 5,463,414 | A | * | 10/1995 | Temple et al. | 347/68 |
| 5,518,969 | A | * | 5/1996 | Ragan | 501/32 |
| 5,762,812 | A | * | 6/1998 | Narang | 216/27 |
| 5,818,481 | A | * | 10/1998 | Hotomi et al. | 347/68 |
| 5,818,483 | A | * | 10/1998 | Mizutani | 347/72 |
| 5,900,288 | A | * | 5/1999 | Kuhman et al. | 427/534 |
| 6,106,092 | A | * | 8/2000 | Norigoe et al. | 347/68 |
| 6,205,032 | B1 | * | 3/2001 | Shepherd | 361/793 |
| 6,290,334 | B1 | * | 9/2001 | Ishinaga et al. | 349/59 |

FOREIGN PATENT DOCUMENTS

| | | |
|---|---|---|
| EP | 0 716 926 A2 | 6/1996 |
| EP | 0 734 865 A2 | 10/1996 |
| JP | 5-147215 | 6/1993 |
| JP | 9-207331 | 8/1997 |
| JP | 10-76669 | 3/1998 |
| JP | 10-146974 | 6/1998 |

* cited by examiner

*Primary Examiner*—Anh T. N. Vo
*Assistant Examiner*—Ly T Tran
(74) *Attorney, Agent, or Firm*—Frishauf, Holtz, Goodman & Chick, P.C.

(57) ABSTRACT

An ink jet head, comprises partition walls made of an piezoelectric material and for dividing ink chambers; and driving electrodes provided on the partition walls, wherein lead conductors each of which is provided at a bottom portion of each ink chamber and is connected with a driving circuit, each lead conductor connected with the driving electrode so that a voltage is applied from the driving circuit through the lead conductor to the driving electrodes for each ink chamber, whereby the partition walls are deformed by shearing forces and an ink is jetted from each ink chamber.

6 Claims, 9 Drawing Sheets

1

INK JET HEAD

BACKGROUND OF THE INVENTION

This invention relates to an ink jet head which jets ink from a nozzle hole by deforming the partition walls of an ink chamber by a shearing force and to the method of manufacturing the ink jet head.

As a letter printing apparatus by the ink jet method of a drop-on-demand type using the shear deformation mode, there is one that jets ink in an ink chamber from a nozzle hole by applying an electric voltage to the electrodes to deform the partition walls partitioning the ink chamber by a shearing force.

In a conventional ink jet head of a shear deformation (shear mode) type, the drive electrode for shear-deforming (deforming by a shearing force) the partition wall is usually connected to the outside wiring with a lead wire along the partition wall by utilizing the bending portion formed at the time of working the slot forming the ink chamber. According to this method, it is difficult to lead outside the electrode provided at the inner wall of the ink chamber; hence, a compact design of an ink jet head can not be made.

Further, owing to a long outside-leading wire from the drive electrode provided at the inner wall of the ink chamber made up of a piezoelectric element, an electrostatic capacitance which can not be neglected in comparison with the electrostatic capacitance of the driving electrode portion is produced because of the high dielectric constant of the piezoelectric element, to make the load for driving large. For example, the load for driving becomes 2 to 4 times the load of the actual driving portion; thus, the heat generation during the driving poses a problem, and in particular, it makes an obstacle in the case where a high-speed ink jet printing unit having multiple nozzles is brought into actual use.

SUMMARY OF THE INVENTION

This invention has been done in view of the above-described points, and it is an object of the invention to provide an ink jet head which is capable of being driven at a high speed, is capable of making a high-quality image recording, has drive electrodes which are led outside in a simple way and reliably, is of low cost, and has a possibility to be made compact, and the method of manufacturing the same.

In order to solve the above-described problems and to accomplish the object, the structure of this invention has been made as follows:

An ink jet head, comprises:

partition walls made of an piezoelectric material and for dividing ink chambers;

driving electrodes provided on the partition walls, and lead conductors each of which is provided at a bottom portion of each ink chamber and is connected with a driving circuit, each lead conductor connected with the driving electrodes at the bottom portion of each ink chamber so that a voltage is applied from the driving circuit through the lead conductor to the driving electrodes for each ink chamber, whereby the partition walls are deformed by shearing forces and an ink is jetted from each ink chamber.

Further, the above object may be attained by the following preferable structures.

(1) An ink jet head comprising ink chambers provided in a piezoelectric element and drive electrodes provided on the partition walls partitioning said ink chambers, jetting ink from nozzle holes by applying an electric voltage to said drive electrodes to shear-deform (deform by a shearing force) said partition walls partitioning said ink chambers, wherein said drive electrodes provided on said partition walls are connected to lead conductors from a drive circuit provided at the bottom side of said ink chambers.

According to the invention set forth in the above paragraph (1), the drive electrodes are connected to the lead conductors from the drive circuit provided at the bottom side of the ink chambers, that is, connected to the outside drive circuit at positions directly beneath the driving portions; hence, the electrostatic capacitance owing to the connection can be neglected to generate only a small amount of heat, and drive electrodes can be made light-weighted and small-sized. Thus, a line head with highly integrated nozzles which is capable of being driven at a high speed and is capable of making a high-quality image recording can be actualized, and the power source of the printing unit equipped with the ink jet head can be made small-sized and of small rated power. Further, the outside-leading of the drive electrodes is simple and reliable, to make a small-sized printing unit which is of low cost and compact, works at high speed and records an image of a high definition and high quality.

(2) An ink jet head set forth in the paragraph (1), wherein a print wiring substrate is used for the lead conductors from the aforesaid drive circuit, the aforesaid piezoelectric element is provided on this printed circuit board, the aforesaid ink chambers are formed at positions agreeing with the wiring positions in such a manner as to make the lead conductors exposed, and the aforesaid drive electrodes are connected to the lead conductors at the time of forming said drive electrodes on the partition walls.

According to the invention set forth in the above paragraph (2), the piezoelectric element is provided on the printed circuit board, the ink chambers are formed at the positions agreeing with the wiring positions in such a manner as to make the lead conductors exposed, and the drive electrodes are connected to the lead conductors at the time of forming said drive electrodes on the partition walls; hence, a process such as wire bonding or soldering as is heretofore done is not required, and the connection to the lead conductors from the drive circuit can be made simultaneously at the time of attaching the drive electrodes, to make it possible to omit the wiring process; thus, the outside-leading of the drive electrodes is simple and reliable, to make the ink jet head of low cost and compact.

(3) An ink jet head set forth in the paragraph (2), wherein the aforesaid printed circuit board has through-holes at the positions corresponding to the aforesaid ink chambers, and the aforesaid drive electrodes are connected to the lead conductors provided in these through-holes.

According to the invention set forth in the above paragraph (3), the printed circuit board has through-holes at the positions corresponding to the ink chambers, and the drive electrodes are connected to the lead conductors provided in these through-holes; hence, it is prevented that the wiring pattern of the printed circuit board is shaved off to make a poor connection at the time of working the ink chamber owing to the error in the depth of working.

(4) An ink jet head set forth in the paragraph (2) or (3), wherein the aforesaid printed circuit board is made of a material having a Young's modulus larger than that of the piezoelectric element.

According to the invention set forth in the above paragraph (4), the printed circuit board is made of a material having a Young's modulus larger than that of the piezoelectric element; hence, the piezoelectric element can be reliably supported even when the partition walls of the ink chambers are shear-deformed.

(5) An ink jet head set forth in the paragraph (2) or (4), wherein the aforesaid printed circuit board is made of a non-piezoelectric ceramics material.

According to the invention set forth in the above paragraph (5), the printed circuit board is made of a non-piezoelectric ceramics material; hence, the piezoelectric element can be reliably supported even when the partition walls of the ink chambers are shear-deformed.

(6) An ink jet head set forth in the paragraph (5), wherein the aforesaid non-piezoelectric ceramics material is at least any one selected from alumina, aluminum nitride, zirconia, silicon, silicon nitride, silicon carbide, and quartz.

According to the invention set forth in the above paragraph (6), the non-piezoelectric ceramics material is at least any one selected from alumina, aluminum nitride, zirconia, silicon, silicon nitride, silicon carbide, and quartz; hence, the piezoelectric element can be reliably supported.

(7) An ink jet head set forth in any one of the paragraphs (2) to (6), wherein at least the surface of the aforesaid printed circuit board to make the bottom of the ink chambers is a smooth surface.

According to the invention set forth in the above paragraph (7), the surface of the printed circuit board to make the bottom of the ink chambers is a smooth surface; hence, the thickness of the adhesive layer to bond the printed circuit board and the piezoelectric element can be made thin, and the both rigid bodies can be held together, to make the jetting efficiency high.

(8) An ink jet head set forth in any one of the paragraphs (2) to (7), wherein the aforesaid printed circuit board is connected to a drive circuit board which is separately provided to this printed circuit board, and a drive circuit is built on said drive circuit board.

According to the invention set forth in the above paragraph (8), the printed circuit board is connected to a drive circuit board which is separately provided, and a drive circuit is built on said drive circuit board; hence, the ease of operation for attaching the drive circuit is improved and the degree of freedom in designing is enlarged.

(9) An ink jet head set forth in any one of the paragraphs (1) to (7), wherein a drive circuit is built on the aforesaid printed circuit board, and this drive circuit is connected to the aforesaid drive electrodes.

According to the invention set forth in the above paragraph (9), a drive circuit is built on the printed circuit board, and this drive circuit is connected to the aforesaid drive electrodes; hence, the outside-leading of the drive electrodes is simple and reliable, and the ink jet head becomes of low cost and compact.

(10) An ink jet head set forth in any one of the paragraphs (1) to (9), wherein ink supply paths leading to the aforesaid ink chambers are formed in the aforesaid printed circuit board.

According to the invention set forth in the above paragraph (10), ink supply paths leading to the aforesaid ink chambers are formed in the aforesaid printed circuit board; hence, it is easy to make a piping work for supplying ink.

(11) The method of manufacturing an ink jet head comprising the steps of bonding a printed circuit board provided with lead conductors in its through-holes and a piezoelectric element, slightly shaving off the surface of said printed circuit board by working ink chambers from the side of the piezoelectric element after the bonding, making said lead conductors in said through-holes exposed, forming drive electrodes on the inner walls of said ink chambers and connecting them to said lead conductors, and bonding a cover member to said piezoelectric element to close the ink chambers.

According to the invention set forth in the paragraph (11), the electrodes are connected to the outside drive circuit at the positions directly beneath the driving portions; hence, the electrostatic capacitance produced by the connection can be neglected to make the drive power source light-weighted and small-sized, and on top of it, a special connecting process can be omitted because the connection to the lead conductors of the drive circuit can be carried out simultaneously at the time of attaching the drive electrodes. Thus, the ink jet head is capable of being driven at a high speed, is capable of making a high-quality image recording, has drive electrodes which are led outside in a simple way and reliably, is of low cost, and has a possibility to be made compact.

DETAILED DESCRIPTION OF THE PREFERRED EMBODIMENT

In the following, examples of the embodiment of an ink jet head and the method of manufacturing the ink jet head of this invention will be explained, but the mode of this invention should not be limited to these.

Figure 1:
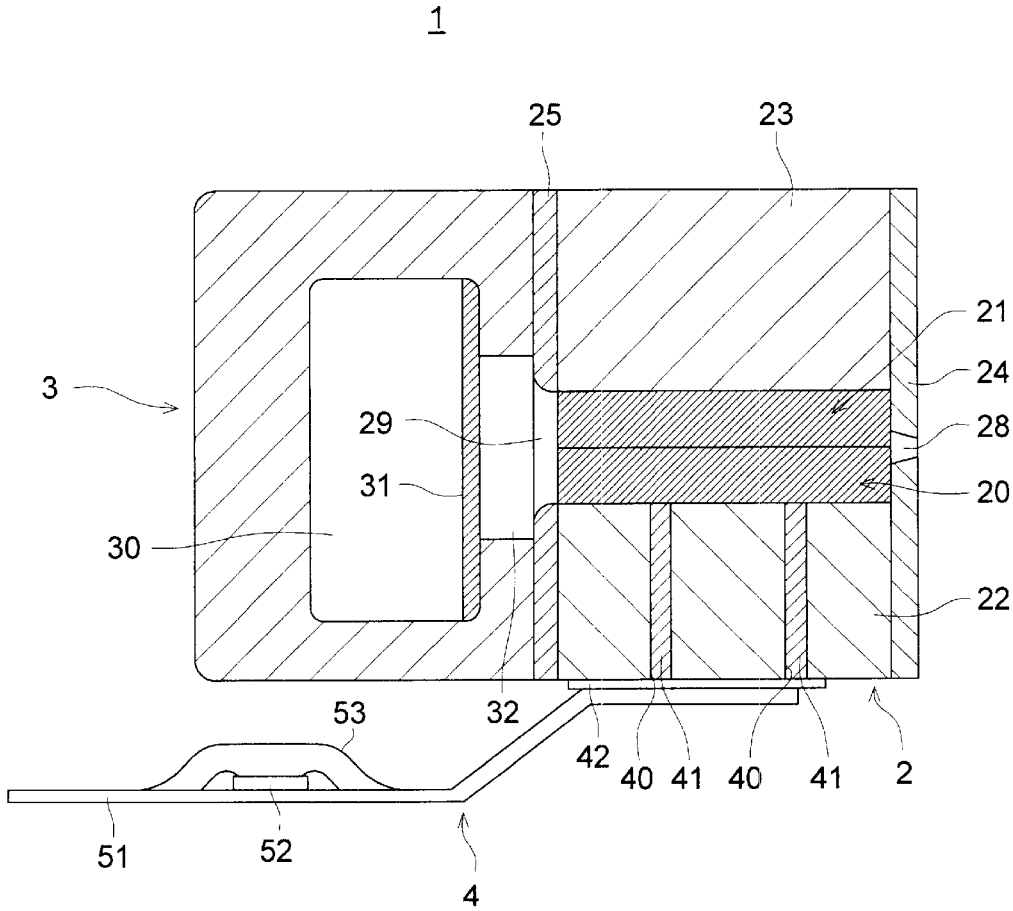
FIG. 1 is a drawing showing a printing unit equipped with an ink jet head of a chevron type.
Figure 2:
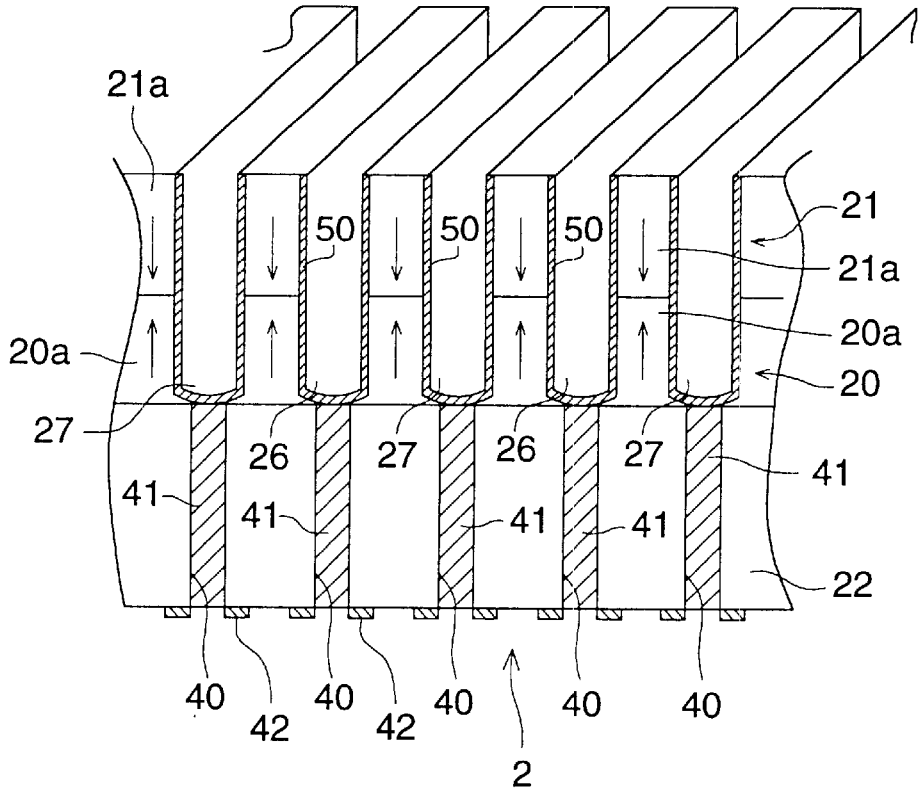
FIG. 2 is a drawing showing the lead-out of drive electrodes of an ink jet head of a chevron type.

FIG. 1 is a drawing showing a printing unit equipped with an ink jet head of a chevron type, and FIG. 2 is a drawing showing the outside-leading of drive electrodes of an ink jet head of a chevron type.

The printing unit 1 of this embodiment comprises the ink jet head 2, the ink supply portion 3, and the drive portion 4. The ink jet head 2 comprises the piezoelectric elements 20 and 21, the printed circuit board 22, the cover member 23, the nozzle plate 24, and the partition sheet 25. The ink chambers 26 and the air chambers 27 are alternately formed in the piezoelectric elements 20 and 21, the nozzle holes 28 are formed at the positions corresponding to the ink chambers 26 in said nozzle plate, and the ink supply holes 29 are formed at the positions corresponding to the ink chambers in the partition sheet 25.

In the ink supply portion 3, there is provided the ink pool 30, from which ink is conducted to the ink supply holes 29 through the ink filter 31 and the ink supply paths 32. In the printed circuit board 22, the through-holes 40 are formed at the positions corresponding to the ink chambers 26 and the air chambers 27, and in these through-holes 40, the lead conductors 41 are provided. On the partition walls 20*a* and 21*a* which partition the ink chambers 26 and the air chambers 27, the drive electrodes 50 are provided, and these drive electrodes are provided throughout the holes to the bottom to be connected to the outside lead wires 42 which are provided on the printed circuit board 22.

In the drive portion 4, there is provided the drive circuit board 51, which is made up of a flexible wiring board and is connected to the outside lead wires 42. The drive circuit 52 is built on the drive circuit board 51, and is made up of a drive IC. The drive circuit 52 is covered by the protective sheet 53.

For the manufacturing of this ink jet head of a chevron type 2, the lead conductors 41 are provided beforehand in the through-holes 40 of the printed circuit board 22, while the piezoelectric element 20 and the piezoelectric element 21 are bonded, and the piezoelectric element 20 is bonded to the printed circuit board 22. After this bonding, slots are formed with a predetermined interval from the side of the piezoelectric elements 20 and 21, to carry out the working for forming the ink chambers 26 and the air chambers 27 alternately. In this working for forming the slots with a predetermined interval, the surface of the printed circuit board 22 is slightly shaved, to expose the lead conductors 41 in the through-holes 40.

The drive electrodes 50 are formed on the partition walls 20*a* and 21*a* which partition the ink chambers 26 and the air chambers 27, and the lead conductors 41 are connected to these drive electrodes 50. After that, the cover member 23 is bonded to the piezoelectric element 21, and further, the nozzle plate 24 and the partition sheet 25 are bonded respectively to the both sides of the above-mentioned bonded members to close the ink chambers 26 and the air chambers 27.

For the metal to make the drive electrodes 50 and the lead conductors 41, gold, silver, aluminum, palladium, nickel, tantalum, and titanium can be used, and in particular, gold and aluminum are good in view of electrical properties and workability; they are formed by plating, evaporation, and sputtering.

Here, it may be preferable to form the lead conductors such that the through-holes 40 in the print wiring board 22 is filled with a metal paste of electrode by a screen printing and the filled metal paste is dried. In the case that the board 22 is manufactured such that a plurality of ceramics green sheets are superimposed and sintered, it may be preferable that the through-holes 40 in the print wiring board 22 is filled with a metal paste of electrode by a screen printing before the sintering. It may be preferable to form the drive electrodes 50 such that aluminum is deposited on wall surfaces of grooves provided in the piezoelectric elements 20 and 21 by the vapor deposition in an oblique direction. At the time of this vapor deposition, an aluminum layer is formed on the surface of the exposed lead conductors 41, thereby automatically constructing a firm connection between the drive electrodes 50 and the lead conductors 41. Alternately, in the case that the drive electrodes 50 is formed by no-electric filed plating of Ni and Au, the connection between the drive electrodes 50 and the lead conductors 41 is also firmly constructed. At this plating, a portion on which no plating layer is required can be formed by a masking tape or by eliminating a plating layer by a laser cutting.

In this printing unit 1, ink is supplied from the ink tank 30 in the ink supply portion 3 to the ink chambers 26 through the ink supply holes 29 in the ink jet head 2, and the ink supply holes 29 are formed at the positions opposite to the nozzle holes 28.

By actuating the drive circuit 52 in the drive portion 4, to apply an electric voltage from the drive circuit board 51 to the drive electrodes 50 through the outside lead wires 42 and the lead conductors 41, the partition walls 20*a* and 21*a* which partition the ink chambers 26 and the air chambers 27 are shear-deformed to jet the ink in the ink chambers 26 from the nozzle holes 28.

As described in the above, the drive electrodes 50 are connected to the lead conductors 41 from the drive circuit 52, said lead conductors 41 being provided at the bottom side of the ink chambers 26 and the air chambers 27, and the drive electrodes 50 are connected to the outside drive circuit 52 at the positions directly beneath the drive portions; hence, the electrostatic capacitance owing to the connection can be neglected, and the amount of heat generation is small, to make it possible to reduce the weight of the power source for driving; thus, a line head with highly integrated nozzles capable of carrying out a high quality image recording can be actualized, and the power source of the printing unit is made small-sized and to have a small output power. Further, the outside-leading of the drive electrodes 50 is simple and reliable, to make a high-speed, high-definition, and high-quality small-sized printing unit, which is of low cost and compact.

Further, the printed circuit board 22 is used for the wiring from the drive circuit 52, the piezoelectric elements 20 and 21 are provided on this printed circuit board 22, the ink chambers 26 and the air chambers 27 are formed at the positions agreeing with the wiring positions in such a manner as to make the lead conductors 41 exposed, and the drive electrodes 50 are connected to the lead conductors 41 at the time of forming said drive electrodes 50 on the partition walls 20*a* and 20*b;* hence, a process such as wire bonding or soldering as is heretofore done is not required, and the connection to the lead conductors 41 from the drive circuit 52 can be made simultaneously at the time of attaching the drive electrodes 50, to make it possible to omit the wiring process; thus, the outside-leading of the drive electrodes 50 is simple and reliable, to make the ink jet head of low cost and compact.

No matter whether a chamber is an ink chamber or an air chamber, when a groove is machined in the piezoelectric elements 20 and 21, if a part of the top surface of the lead conductors 41 in the board 22 is scraped simultaneously, since the part of the top surface of the lead conductors 41 can be necessarily exposed even if the machine-out depth of the groove is deviated, an insufficient connection can be avoided.

The printed circuit board 22 is made of a material having a Young's modulus larger than that of the piezoelectric elements 20 and 21, for example, made of a non-piezoelectric ceramics material; hence, the piezoelectric element can be reliably supported even when the partition walls 20*a* and 21*a* of the ink chambers 26 and the air chambers 27 are shear-deformed. The non-piezoelectric ceramics material is at least any one selected from alumina, aluminum nitride, zirconia, silicon, silicon nitride, silicon carbide, and quartz; hence, the piezoelectric element can be reliably supported.

The surface of the printed circuit board 22 to make the bottom of the ink chambers is a smooth surface; hence, the thickness of the adhesive layer to bond the printed circuit board 22 and the piezoelectric element 20 can be made thin, and the both rigid bodies can be held together, to make the jetting efficiency high.

Further, the printed circuit board 22 is connected to the drive circuit board 51 which is separately provided to the printed circuit board 22, and the drive circuit 52 is built on said drive circuit board 51; hence, the ease of operation for attaching the drive circuit 52 is improved and the degree of freedom in designing is enlarged.

Further, the cover member 23 is made of a non-piezoelectric ceramics material, and for example, aluminum is used for this non-piezoelectric ceramics material.

Figure 3:
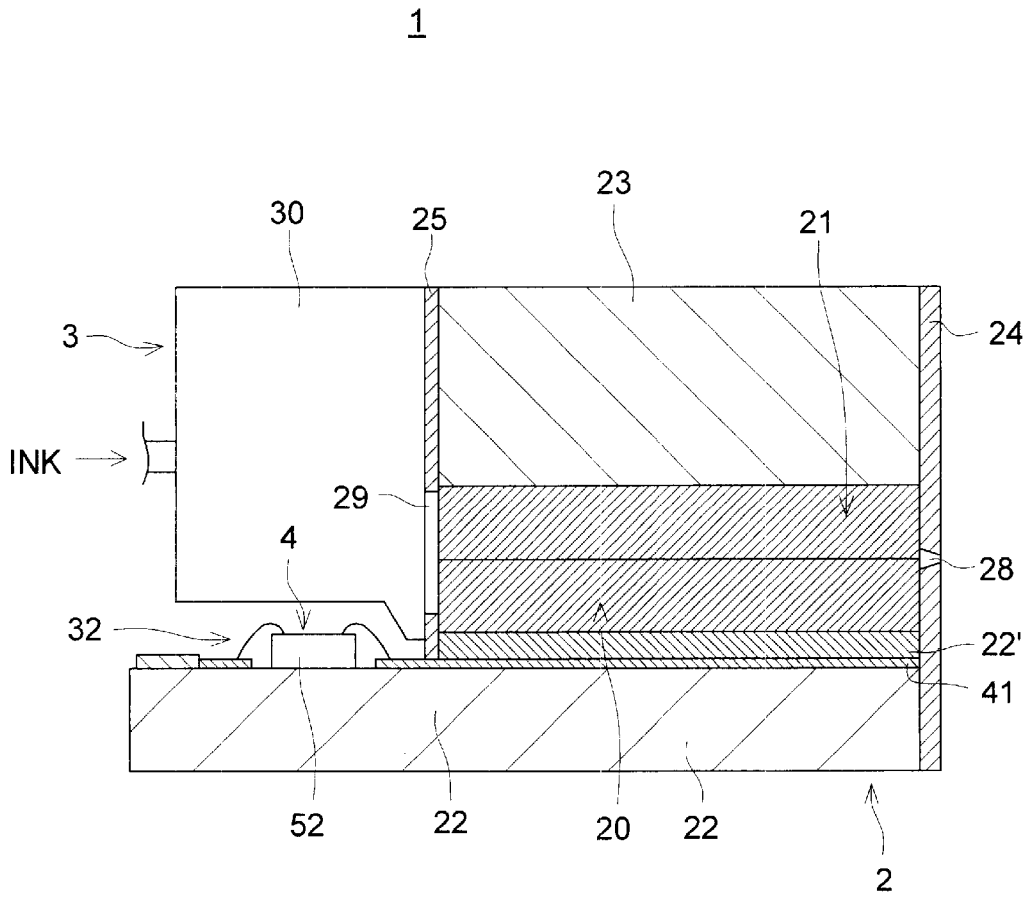
FIG. 3 is a drawing showing a printing unit equipped with an ink jet head of a chevron type.
Figure 4:
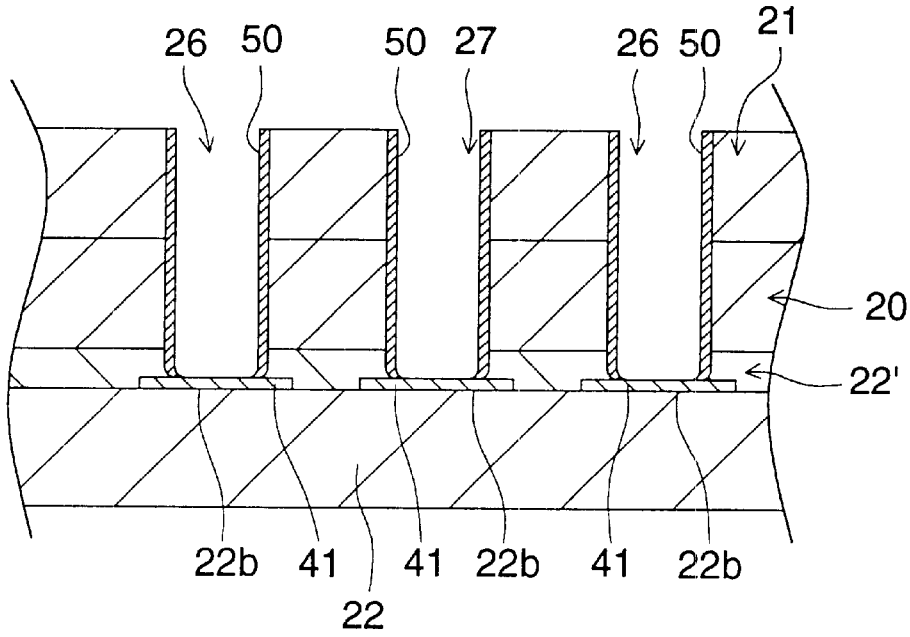
FIG. 4 is a drawing showing the lead-out of drive electrodes of an ink jet head of a chevron type.

Next, an embodiment wherein the drive circuit 52 is built on the printed circuit board 22, and is connected to the drive electrodes 50 is shown in FIG. 3 and FIG. 4. FIG. 3 is a drawing showing a printing unit equipped with an ink jet head of a chevron type, and FIG. 4 is a drawing showing the outside-leading of the drive electrodes of an ink jet head of a chevron type.

In this embodiment, the two boards of the thick printed circuit board 22 and the thin printed circuit board 22 are stacked, and on this thin printed circuit board 22, the concave portions 22*b* are formed at the positions corresponding to the ink chambers 26 and the air chambers 27, and in this concave portions 22*b*, the lead conductors 41 are formed. The piezoelectric elements 20 and 21 are worked for the slots to form the ink chambers 26 and the air chambers 27 at the positions agreeing with the wiring positions in such a manner as to make the lead conductors 41 exposed, and the drive electrodes are connected to the lead conductors 41 when they are formed on the partition walls 20*a* and 21*a*. The drive circuit 52 is built on the thick printed circuit board 22, and is connected to the lead conductors 41; thus, the drive circuit 52 is connected to the drive electrodes 50 through the lead conductors 41.

By making the printed circuit board 22 having a glass epoxy construction in two layer structure of a thick board and a thin board, a pattern electrode 41 can be easily precisely provided on the thick board having a thickness of 0.3 mm to 3 mm at low cost. On the other hand, by forming concaves 22*b* in the thin board having a thickness of 0.05 mm to 0.3 mm and pasting the thin board with a piezoelectric element, a connection between a lead conductor 41 and a drive electrode 50 can be made firmly and easily.

As described in the above, the drive circuit 52 is built on the printed circuit board 22 and is connected to the drive electrodes 50; hence, the outside-leading of the drive electrodes 50 is simple and reliable to make an ink jet head of low cost and compact.

Figure 5:
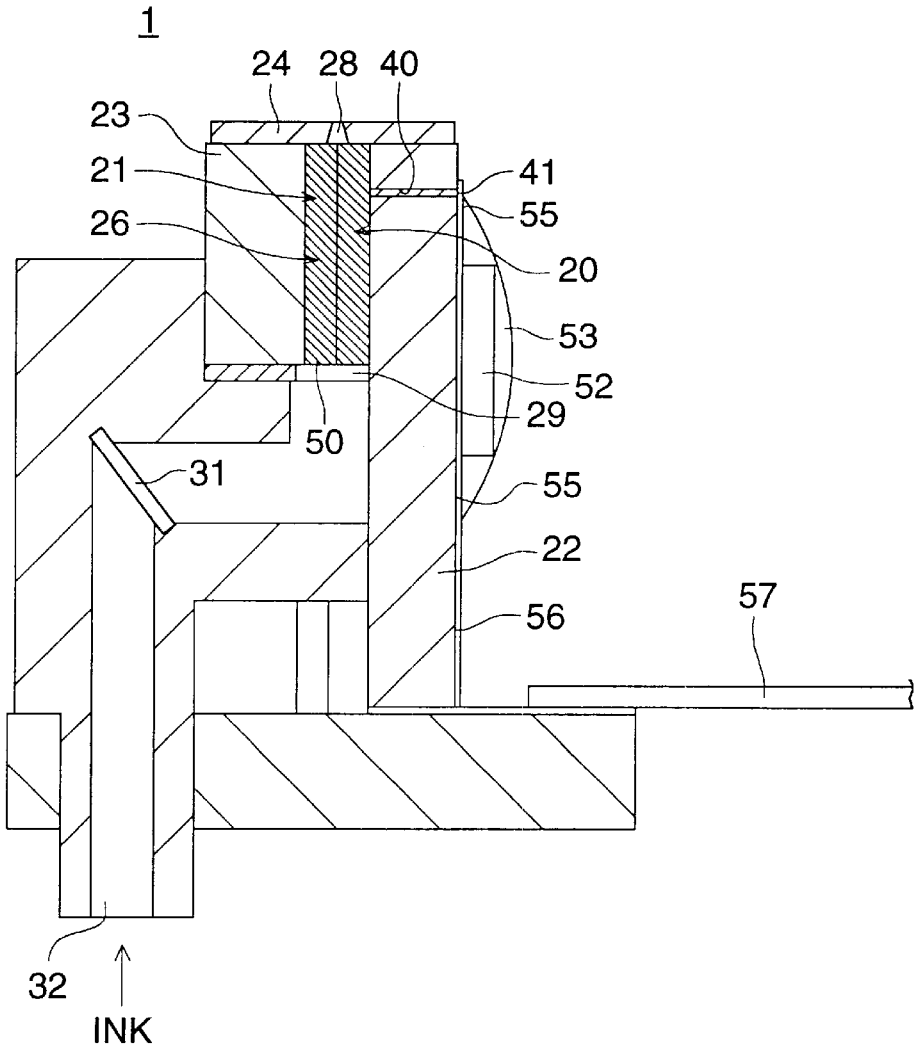
FIG. 5 is a drawing showing a printing unit equipped with an ink jet head of a chevron type.

Next, another embodiment wherein the drive circuit 52 is built on the printed circuit board 22, and is connected to the drive electrodes 50 is shown in FIG. 5. FIG. 5 is a drawing showing a printing unit equipped with an ink jet head of a chevron type.

In this embodiment, the lead wires 55 are formed on the opposite side to the drive electrodes 50 on the printed circuit board 22, and are connected to the drive circuit 52 built on the printed circuit board 22. The lead wires 55 are connected to the lead conductors 41 which are provided in the through-holes 40 of the printed circuit board 22. Further, the outside lead wires 56 are connected to the drive circuit 52, and the flexible board 57 is connected to these outside lead wires 57, which are connected to the external control portion etc. By mounting a driving IC directly on the circuit board, since it is not necessary to connect the printed circuit board with another flexible board on which the driving IC is mounted, a compact print head can be provided. With this compact print head, when the head is incorporated in a printer, a size and a weight of a carriage can be reduced, whereby a high speed printer can be manufactured with a small size and a light weight. As described in the above, the drive circuit 52 is built on the printed circuit board 22, and is connected to the drive electrodes 50; hence, the outside-leading of the drive electrodes 50 is simple and reliable, to make the ink jet head of low cost and compact.

Figure 6:
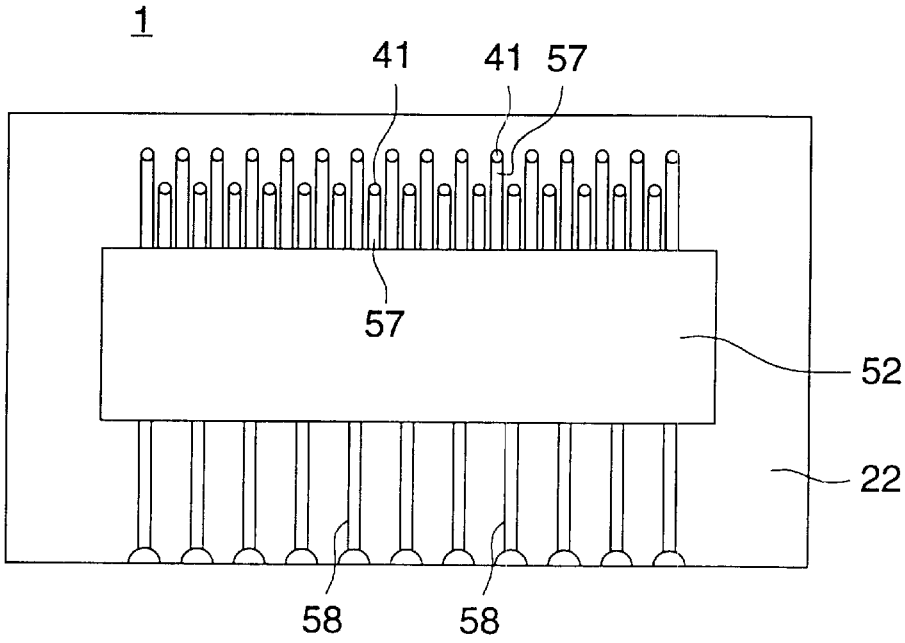
FIGS. 6(*a*) and 6(*b*) are drawings showing an ink jet head of a chevron type.
Figure 6:
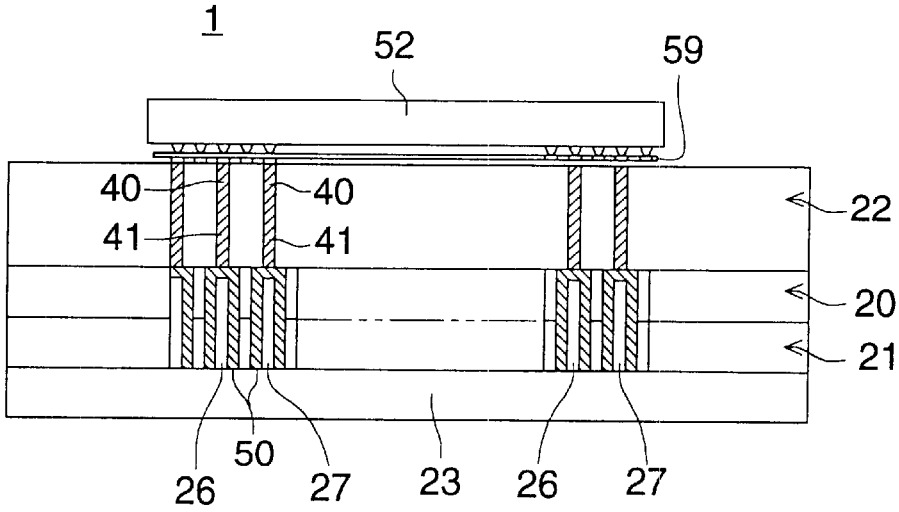

Next, a further embodiment wherein the drive circuit 52 is built on the printed circuit board 22, and is connected to the drive electrodes 50 is shown in FIG. 6. FIG. 6(*a*) is the plan of an ink jet head of a chevron type, and FIG. 6(*b*) is a cross-sectional view of the ink jet head of a chevron type.

In this embodiment, the lead wires 57 are formed on the opposite side to the drive electrodes 50 on the printed circuit board 22, and are connected to the drive circuit 52 built on the printed circuit board 22. The lead wires 57 are connected to the lead conductors 41 which are provided in the through-holes 40 of the printed circuit board 22. Further, the outside lead wires 58 are connected to the drive circuit 52.

As shown in FIG. 6(*b*), the lead wires 57 and the outside lead wires 58 are connected through the anisotropic conductive film 59, the drive circuit 52 is built on the printed circuit board 22, and the drive electrodes 50 are connected to this drive circuit 52; hence, the outside-leading of the drive electrodes is simple and reliable, to make the ink jet head of low cost and compact.

Figure 7:
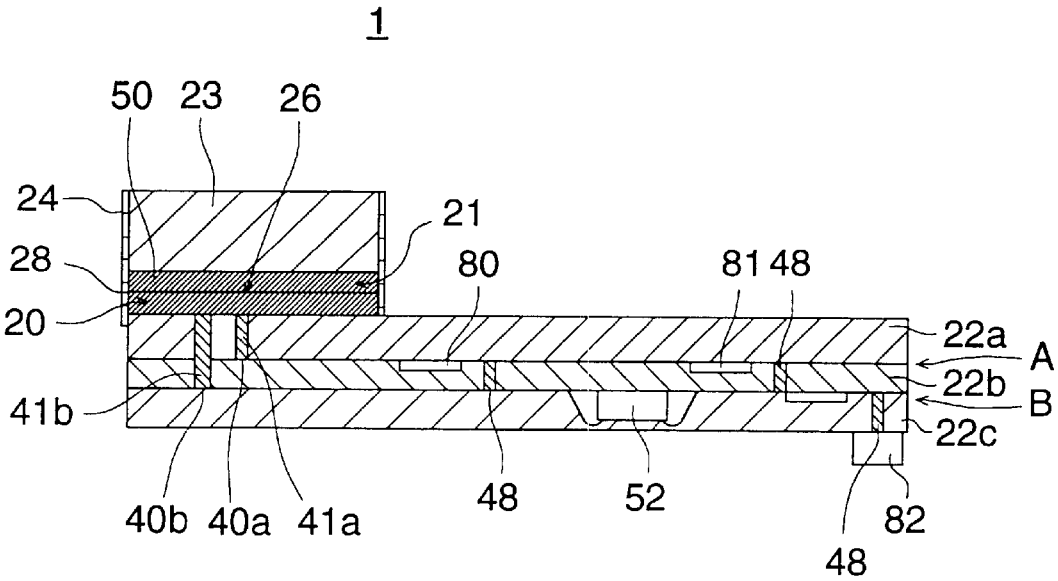
FIG. 7 is a cross-sectional view of an ink jet head of a chevron type.

Next, a further embodiment wherein the drive circuit 52 is built on the printed circuit board 22, and is connected to the drive electrodes 50 is shown in FIG. 7. FIG. 7 is a cross-sectional view of an ink jet head of a chevron type.

In this embodiment, the printed circuit board is made up of multiple layers, that is, three layers, and the through-holes are provided in this printed circuit board 22 made up of three layers, and the lead conductors 41 provided in these through-holes 40 are connected to the drive electrodes 50.

The drive IC making up the drive circuit 52 is buried between the bottom layer and the intermediate layer of the printed circuit board 22. Further, in the intermediate layer of the printed circuit board 22, the resistors 80 and the capacitors 81 are buried; further, in the bottom and intermediate layers of the printed circuit board 22, the connecting wires 48 are provided, and the connector 82 is fitted to one of the connecting wires 48 on the bottom layer of the printed circuit board 22.

The lead conductors 41*a* is connected with an electrode pattern (not illustrated) provided on a joint surface A between boards 22*a* and 22*b* and further connected through a conductor 48 with an electrode pattern (not illustrated) provided on a joint surface B between boards 22*b* and 22*c*, whereby the lead conductors 41*a* is connected with a driving IC 52 embedded in the circuit board 22*c*.

As described in the above, the printed circuit board 22 is made up of multiple layers, and the drive IC making up the drive circuit is buried in the printed circuit board 22 made up of multiple layers; hence, the driving circuit including all electric components such as a driving IC, a resister, a capacitor, a thermister, a coil and a connector, necessary for driving the print head may be constructed in a single body, thereby making the outside-leading of the drive electrodes simple and making the print head in compact with a high reliability.

Figure 8:
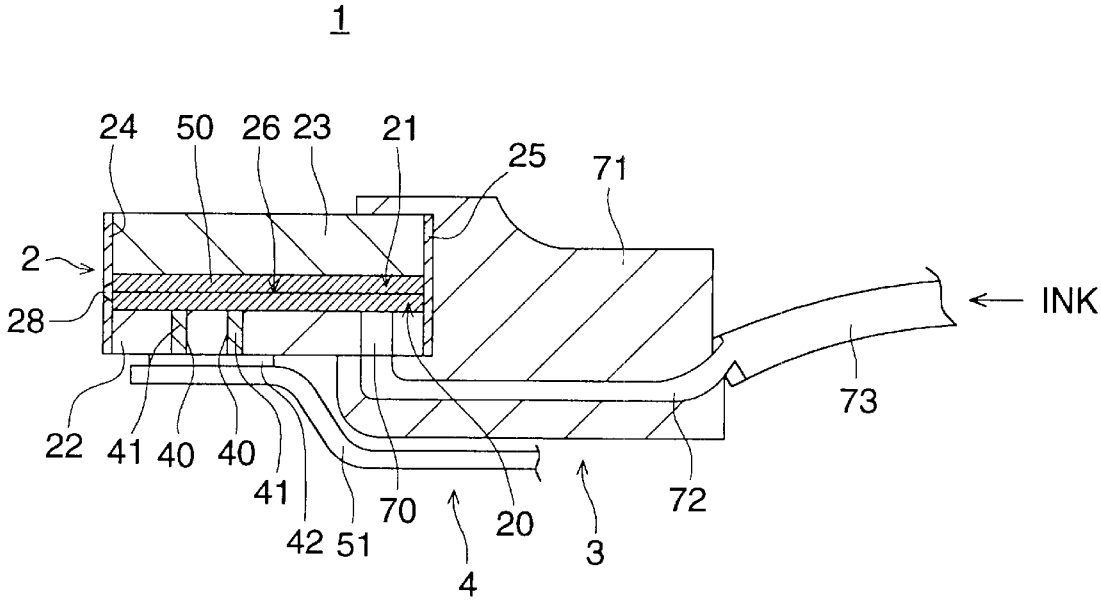
FIG. 8 is a drawing showing a printing unit equipped with an ink jet head of a chevron type.

Next, an embodiment wherein the ink supply paths 70 which lead to the ink chambers 26 are formed is shown in FIG. 8. FIG. 8 is a drawing showing a printing unit equipped with an ink jet head of a chevron type.

In this embodiment, the members which are given the same signs respectively as those in FIG. 1 and FIG. 2 are made up in the same way; therefore, the explanation for them will be omitted. In this embodiment, the ink supply paths 70 leading to the ink chambers 26 are formed in the printed circuit board 22, and the ink supply conduit 72 formed in the ink supply member 71 is connected to these ink supply paths 70, and further, the ink tube 73 is connected to the ink supply conduit 72.

The diameter of these ink supply paths 70 is desirably 10 to 500 μm, or should more desirably be 100 to 200 μm. Further, the inner wall of the ink supply paths 70 is covered by an organic protective layer, in order that the printed circuit board should not be corroded by the ink. As described in the above, the ink supply paths 70 leading to the ink chambers 26 are formed in the printed circuit board 22; hence, the piping for supplying ink is made easy.

Figure 9:
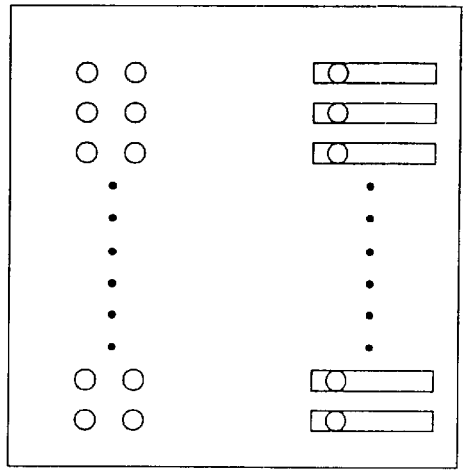
FIGS. 9(*a*) to 9(*c*) are drawings showing an example of practice of a printed circuit board.
Figure 9:
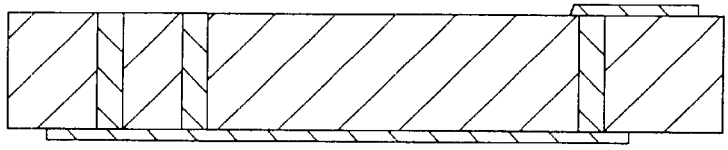
Figure 9:
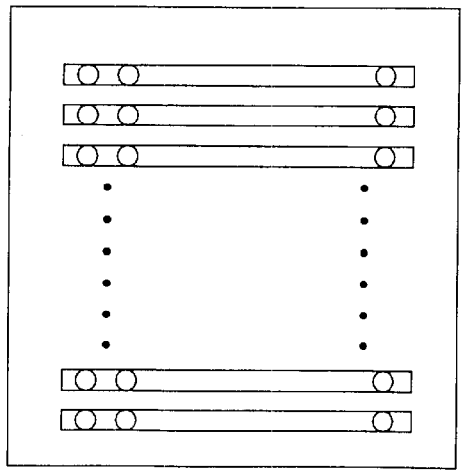

Next, an example of practice of the printed circuit board 22 is shown in FIG. 9. FIG. 9(*a*) is the plan of the printed circuit board, FIG. 9(*b*) is a cross-sectional view of the printed circuit board, and FIG. 9(*c*) is the bottom view of the printed circuit board.

For the printed circuit board of this embodiment, an LTCC non-contracting board is used and the thickness of the board is 0.635 mm. Regarding the wiring pattern, the line pitch is 140±5 μm, the wiring pitch of the through-holes is 140±5 μm, the width of the line is 70±10 μm, and the diameter of the wires in the through-holes is 70±5 μm.

For the LTCC non-contracting board, for example, DU PON GREEN TAPE #951 is used. The contraction ratio is not larger than 0.1±0.005%, and the precision of the wiring pattern is ±1 to ±5 μm in terms of accumulated positional deviation. The smoothness is better than (10 μm)/(10 mm), and the board is able to be bonded by an adhesive, has enough bonding strength, and is sensitive to a piezoelectric element. Further, the LTCC non-contracting board is capable of multi-layer wiring, in which resistors and capacitors are buried in the circuit board and a drive IC can be provided in a concave portion made by boring.

Here, "the smoothness is not larger than (10 μm)/(10 mm)" means when a surface roughness is measured by a contact stylus instrument (or contact profile meter, such as an instrument produced by Taristep Corporation), a surface roughness Ra is not larger than 10 μm with a measuring width of 10 mm in any optional direction.

To state the values of the characteristics of the LTCC non-contracting board, the dielectric constant is 7.8 at 10 MHz, the coefficient of thermal expansion is preferably not larger than 10 ppm/deg, more preferably not larger than 6 ppm/deg, the thermal conductivity is 30 w/m-deg, and the Young's modulus is 200 GPa. The thickness of the pattern conductor is not larger than 30 μm, or should desirably be not larger than 10 μm, or should more desirably be not larger than 5 μm, at which bonding by an adhesive is possible.

In the above-described embodiments, the ink jet heads of a chevron type have been explained; however, this invention can be brought into practice in an ink jet head of a cantilever type in the same manner. Further, the embodiments wherein the ink chambers and the air chambers are alternately formed have been explained; however, this invention can be put into practice in an ink jet head having ink chambers formed without providing air chambers.

In these ink jet heads of a cantilever type and of a chevron type, for the material of the non-piezoelectric ceramics substrate, it is desirable to select at least one out of alumina, aluminum nitride, zirconia, silicon, silicon nitride, silicon carbide, and quartz; thus, the piezoelectric ceramics can be reliably supported by it even when the partition walls of the ink chambers are deformed by a shearing force.

Further, for the piezoelectric ceramics material, it is desirable a ceramics material such as PZT and PLZT, which is composed of a mixture of micro-crystalline PbOx, ZrOx, and TiOx including a minute amount of a metallic oxide which is known as a softening agent or a hardening agent such as, for example, an oxide of Nb, Zn, Mg, Sn, Ni, La, or Cr.

PZT is the mixture of lead titanate and lead zirconate, and it is a desirable material owing to a large packing density, a large piezoelectric constant, and a good workability. When the temperature is lowered after burning, PZT has its crystalline structure suddenly varied to make the atoms deviate, and becomes an aggregate of micro-crystals in the form of dipoles each having a positive pole at one end and a negative pole at the other end. In such spontaneous polarization, dipoles have random directions to cancel their dipole moment one another; therefore, a further polarizing process is required.

In the polarizing process, a thin plate of PZT is placed between electrodes, is dipped in a silicone oil, and is polarized by the application of a high electric field in the range of 10 to 35 kV/cm. When an electric field is applied to a polarized PZT plate in the direction perpendicular to the direction of its polarization, the side walls are deformed by the shearing force in an oblique direction to a doglegged shape by piezoelectric slipping effect to make the volume of the ink chamber expand.

In the following, the values of the physical properties of the non-piezoelectric ceramics substrate and the piezoelectric ceramics will be explained.

The density [g/cm$^3$] of the piezoelectric ceramics is 8.2, and the density [g/cm$^3$] of the non-piezoelectric ceramics substrate is let to be equal to or smaller than 3.0; however, the density [g/cm$^3$] of the non-piezoelectric ceramics substrate should desirably be smaller, for example, equal to or smaller than a half of the above; thus, the head as a whole becomes lighter to make it possible to obtain a compact head.

The Young's modulus or the elastic constant [GPa] of the piezoelectric ceramics is 6.5, and the Young's modulus [GPa] of the non-piezoelectric ceramics substrate is let to be 190 to 390; however, the Young's modulus [GPa] of the non-piezoelectric ceramics substrate should desirably be larger, for example, equal to or larger than 200; thus, it can support the displacement of the partition wall of the piezoelectric ceramics firmly, and can make an efficient driving to enable the lowering of applied voltage owing to the small deformation of itself.

The thermal expansion coefficient [ppm/deg] of the piezoelectric ceramics is 2.0, and the thermal expansion coefficient [ppm/deg] of the non-piezoelectric ceramics substrate is let to be 0.6 to 7.0; however, the difference between the both should desirably be equal to or smaller than 5.0, or more desirably should be equal to or smaller than 3.0; thus, it can be prevented the breakdown by the bending and the stress owing to the difference between the thermal expansions of the substrates which are caused to occur by the heat generation in driving and with the variation of the environment temperature.

The thermal conductivity [W/cm·deg] of the piezoelectric ceramics is 0.01, and the thermal conductivity [W/cm·deg]

of the non-piezoelectric ceramics substrate is let to be 0.03 to 0.3; however, the thermal conductivity [W/cm·deg] of the non-piezoelectric ceramics substrate should desirably be larger, and it becomes more desirable the larger it is, because the heat generated in driving the piezoelectric ceramics can be let to dissipate to the outside through the non-piezoelectric ceramics substrate.

The dielectric constant of the piezoelectric ceramics is 3,000 and the dielectric constant of the non-piezoelectric ceramics substrate is let to be 4.0 to 50; however, it becomes more desirable the smaller it is, and it should desirably be equal to or smaller than 10; further, by putting the electrode pattern for driving the piezoelectric ceramics on the non-piezoelectric ceramics substrate, an additional capacitance is produced on top of the capacitance of the piezoelectric ceramics itself; hence, the capacitance of the ink chamber is increased to cause the heat generation to increase and the driving efficiency to decrease. In this case, the additional capacitance can be made smaller, the smaller the dielectric constant of the non-piezoelectric ceramics becomes.

The hardness [Hv] of the piezoelectric ceramics is 500, and the hardness [Hv] of the non-piezoelectric ceramics substrate is let to be equal to or larger than 1,000; however, the hardness [Hv] of the non-piezoelectric ceramics substrate should desirably be larger, that is, should desirably be equal to or larger than 1.5 times the above value; thus, the lowering of the yield owing to the breaking in the manufacturing process can be prevented.

The bending strength [Kgf/cm$^2$] of the piezoelectric ceramics is 1,000, and the bending strength [Kgf/cm$^2$] of the non-piezoelectric ceramics substrate is let to be 3,000 to 9,000; however, the bending strength [Kgf/cm$^2$] of the non-piezoelectric ceramics substrate should be larger, that is, should desirably be equal to or larger than 2 times the above value, because a long-sized ink jet head can be more stably manufactured the stronger against the warping and bending the non-piezoelectric substrate is.

The volume resistivity [Ω·cm] of the piezoelectric ceramics is 1, and the volume resistivity [Ω·cm] of the non-piezoelectric ceramics substrate is let to be 7 to 10; however, the volume resistivity [Ω·cm] of the non-piezoelectric ceramics substrate should desirably be larger, that is, it is better the larger it is in order to decrease the leakage current as an electronic device.

Further, the surface roughness Ra of the bonding surfaces between the non-piezoelectric ceramics substrate and the piezoelectric ceramics is equal to or smaller than 1.0 μm, and should desirably be equal to or smaller than 0.3 μm, or more desirably should be equal to or smaller than 0.1 μm; if the surface roughness Ra exceeds 1.0 μm, an excessive amount of a soft high-molecular adhesive (an epoxy adhesive, for example) is injected between the bonding surfaces to cause the driving force of the piezoelectric ceramics to be lowered, and it is not desirable to bring about the lowering of the sensitivity and the up-rising of the required electric voltage.

Further, the bonding surfaces between the non-piezoelectric ceramics substrate and the piezoelectric ceramics are subjected to a plasma processing or a UV processing. The plasma processing is a processing in which the non-piezoelectric substrate or the piezoelectric ceramics is placed in a vacuum chamber, and any one or the mixture of Ar, $N_2$, and $O_2$ gases, is introduced in it, and is brought into the state of plasma by the electromagnetic field applied from the outside; a fluorinated hydrocarbon gas such as $CF_4$ may be used in order to enhance the susceptibility to etching of the surfaces. Further, the UV processing is a processing in which the non-piezoelectric ceramics substrate or the piezoelectric ceramics is directly irradiated by an ultra-violet ray emitting lamp, and it may be carried out in an $O_2$ environment in order to produce a cleaning effect by ozone.

As described in the above, by subjecting the bonding surfaces to the plasma processing and UV processing, organic contamination can be cleaned off, wetting performance of the adhesive to the whole surface is improved, and poor bonding such as remaining minute bubbles can be removed; thus, owing to those effects, poor driving of the piezoelectric ceramics can be eliminated, and stable ink jet heads can be manufactured.

Incidentally, in the above embodiment, the ink jet head comprises ink chambers 26 and air chambers 27. However, the present invention can be applied to an embodiment in which an ink head has not air chamber 27 and ink chambers are driven in 3-cycle mode.

As described in the foregoing, according to the invention set forth in the paragraph (1), the drive electrodes are connected to the lead conductors from the drive circuit provided at the bottom side of the ink chambers, that is, connected to the outside drive circuit at the positions directly beneath the driving portions; hence, the electrostatic capacitance owing to the connection can be neglected to generate only a small amount of heat, and drive electrodes can be made light-weighted and small-sized. Thus, a line head with highly integrated nozzles which is capable of being driven at a high speed and is capable of making a high-quality image recording can be actualized, and the power source of a printing unit equipped with the ink jet head can be made small-sized and of small rated power. Further, the outside-leading of the drive electrodes is simple and reliable, to make a small-sized printing unit which is of low cost and compact, works at high speed and records an image of a high definition and high quality.

According to the invention set forth in the paragraph (2), the piezoelectric element is provided on the printed circuit board, the ink chambers are formed at the positions agreeing with the wiring positions in such a manner as to make the lead conductors exposed, and the drive electrodes are connected to the lead conductors at the time of forming said drive electrodes on the partition walls; hence, a process such as wire bonding or soldering as is heretofore done is not required, and the connection to the lead conductors from the drive circuit can be made simultaneously at the time of attaching the drive electrodes, to make it possible to omit the wiring process; thus, the outside-leading of the drive electrodes is simple and reliable, to make the ink jet head of low cost and compact.

According to the invention set forth in the paragraph (3), the printed circuit board has through-holes at the positions corresponding to the ink chambers, and the drive electrodes are connected to the lead conductors provided in these through-holes; hence, it is prevented that the wiring pattern of the printed circuit board is shaved off to make a poor connection at the time of working the ink chambers owing to the error in the depth of working.

According to the invention set forth in the paragraph (4), the printed circuit board is made of a material having a Young's modulus larger than that of the piezoelectric element; hence, the piezoelectric element can be reliably supported even when the partition walls of the ink chambers are shear-deformed.

According to the invention set forth in the paragraph (5), the printed circuit board is made of a non-piezoelectric ceramics material; hence, the piezoelectric element can be reliably supported even when the partition walls of the ink chambers are shear-deformed.

According to the invention set forth in the above paragraph (6), the non-piezoelectric ceramics material is at least any one selected from alumina, aluminum nitride, zirconia, silicon, silicon nitride, silicon carbide, and quartz; hence, the piezoelectric element can be reliably supported.

According to the invention set forth in the paragraph (7), the surface of the printed circuit board to make the bottom of the ink chambers is a smooth surface; hence, the thickness of the adhesive layer to bond the printed circuit board and the piezoelectric element can be made thin, and the both rigid bodies can be held together, to make the jetting efficiency high.

According to the invention set forth in the paragraph (8), the printed circuit board is connected to a drive circuit board which is separately provided, and a drive circuit is built on said drive circuit board; hence, the ease of operation for attaching the drive circuit is improved and the degree of freedom in designing is enlarged.

According to the invention set forth in the paragraph (9), a drive circuit is built on the printed circuit board, and this drive circuit is connected to the drive electrodes; hence, the outside-leading of the drive electrodes is simple and reliable, and the ink jet head becomes of low cost and compact.

According to the invention set forth in the paragraph (10), ink supply paths leading to the aforesaid ink chambers are formed in the aforesaid printed circuit board; hence, it is easy to make a piping work for supplying ink.

According to the invention set forth in the paragraph (11), the electrodes are connected to the outside drive circuit at the positions directly beneath the driving portions; hence, the electrostatic capacitance produced by the connection can be neglected to make the power source for driving light-weighted and small-sized, and on top of it, a special connecting process can be omitted because the connection to the lead conductors of the drive circuit can be carried out simultaneously at the time of attaching the drive electrodes. Thus, the ink jet head is capable of being driven at a high speed, is capable of making a high-quality image recording, has drive electrodes which are led outside in a simple way and reliably, is of low cost, and has a possibility to be made compact.

What is claimed is:

1. An ink jet head, comprising:

a base board;

two partition walls made of an piezoelectric material and mounted on the base board;

a cover plate mounted on the two partition walls so as to construct an ink flow passage, wherein an inner surface of the base board forms a bottom portion of the ink flow passage and the ink flow passage is provided with an ink inlet side at one end thereof and an ink outlet side at another end; two driving electrodes, wherein one of the two driving electrodes is provided on one of the two partition walls and the other of the two driving electrodes is provided on the other of the two partition walls, each of the two driving electrodes elongated to have a length corresponding to the ink flow passage between the ink inlet side and the ink outlet side; the base board having at least two through holes at two positions between the ink inlet side and the ink outlet side on the bottom portion of the ink flow passage; and at least two lead conductors provided in the two through holes, one end of each of the two lead conductors connected to the two driving electrodes and another end of each of the two lead conductors connected to a driving circuit, whereby each of the two driving electrodes is applied with the same voltage at two positions through the two lead conductors from an outer surface side of the base board by the driving circuit.

2. The ink jet head of claim 1, wherein the base board is made of a low temperature co-fired non-contracting ceramic board.

3. An ink jet print head, comprising:

an ink chamber body having a cover plate, a plurality of partition walls made of & piezoelectric material and a nozzle plate so that a plurality of ink chambers are formed in the ink chamber body and each chamber is provided with a nozzle and an actuator to jet ink from each chamber; and a substrate made of low temperature co-fired non contracting ceramic board, wherein the low temperature co-fired non-contracting ceramic board comprises a ceramic board having a plurality of through holes and a plurality of lead conductors each of which is embedded in one of the plurality of through holes and the low temperature co-fired non-contracting ceramic board is manufactured by subjecting the ceramic sheet and the plurality of lead conductors embedded in a plurality of through holes to a sintering process under a low temperature, wherein the ink chamber body having the plurality of ink chambers is mounted on the substrate so that the substrate constitutes bottom portions of the plurality of the ink chambers, and position of each of the plurality of through holes corresponds to a position of each of the bottom portions of the plurality of each chambers, and one end of each lead conductor is connected to the actuator of each of the plurality of ink chambers and another end of each lead conductor is connected to a driving circuit, wherein the young's modulus of the substrate is 190 to 390 (GPa).

4. An ink jet print head, comprising:

an ink chamber body having a cover plate, a plurality of partition walls made of a piezoelectric material and a nozzle plate so that a plurality of ink chambers are formed in the ink chamber body and each chamber is provided with a nozzle and an actuator to jet ink from each chamber; and a substrate made of low temperature co-fired non-contracting ceramic board, wherein the low temperature co-fired non-contracting ceramic board comprises a ceramic board having a plurality of through holes and a plurality of lead conductors each of which is embedded in one of the plurality of through holes and the low temperature co-fired non-contracting ceramic board is manufactured by subjecting the ceramic sheet and the plurality of lead conductors embedded in a plurality of through holes to a sintering process under a low temperature, wherein the ink chamber body having the plurality of ink chambers is mounted on the substrate so that the substrate constitutes bottom portions of the plurality of the ink chambers, and position of each of the plurality of through holes corresponds to a position of each of the bottom portions of the plurality of each chambers, and one end of each lead conductor is connected to the actuator of each of the plurality of ink chambers and another end of each lead conductor is connected to a driving circuit, wherein a difference in thermal expansion coefficient between the ink chamber body and the substrate is 5 (ppm/deg) or less.

5. The ink jet print head of claim 4, wherein the difference is 3 (ppm/deg) or less.

6. An ink jet print head, comprising:

an ink chamber body having a cover plate, a plurality of partition walls made of a piezoelectric material and a nozzle plate so that a plurality of ink chambers are formed in the ink chamber body and each chamber is provided with a nozzle and an actuator to jet ink from each chamber; and a substrate made of low temperature co-fired non-contracting ceramic board, wherein the low temperature co-fired non-contracting ceramic board comprises a ceramic board having a plurality of through holes and a plurality of lead conductors each of which is embedded in one of the plurality of through holes and the low temperature co-fired non-contracting ceramic board is manufactured by subjecting the ceramic sheet and the plurality of lead conductors embedded in a plurality of through holes to a sintering process under a low temperature, wherein the ink chamber body having the plurality of ink chambers is mounted on the substrate so that the substrate constitutes bottom portions off the plurality of the ink chambers, and position of each of the plurality of through holes corresponds to a position of each of the bottom portions of the plurality of each chambers, and one end of each lead conductor is connected to the actuator of each of the plurality of ink chambers and another end of each lead conductor is connected to a driving circuit, wherein the thermal conductivity of the substrate is 0.03 (W/cm·deg) to 0.3 (W/cm·deg), and the thermal conductivity of the substrate is larger than that of the ink chamber body.

* * * * *